US006612253B1

(12) United States Patent
Kuhlman

(10) Patent No.: US 6,612,253 B1
(45) Date of Patent: Sep. 2, 2003

(54) APPARATUS FOR COUPLING TUG BOATS TO BARGES

(76) Inventor: Clare J. Kuhlman, 1000 Intercon Dr., Riverside, MO (US) 64150

( * ) Notice: Subject to any disclaimer, the term of this patent is extended or adjusted under 35 U.S.C. 154(b) by 0 days.

(21) Appl. No.: 10/134,325

(22) Filed: Apr. 29, 2002

(51) Int. Cl.[7] ..... B63B 21/56
(52) U.S. Cl. ..... 114/249; 114/248
(58) Field of Search ..... 114/242, 247–252, 114/258–260

(56) References Cited

U.S. PATENT DOCUMENTS 5,050,522 A * 9/1991 Yamaguichi et al. ..... 114/249

* cited by examiner

*Primary Examiner*—Ed Swinehart
(74) *Attorney, Agent, or Firm*—Spencer Fane Britt & Browne LLP

(57) ABSTRACT

An improved apparatus for coupling a tug boat to a barge having a notch in its stern is provided. Coupling units mounted on the opposite sides of the tug have extendable and retractable rams which engage with channels on the opposite sides of the stern notch. Each ram includes two portions. The first portion can be non-rotatable and is extended and retracted by an actuator screw driven by a motor. The second portion can rotate relative to the first portion. Additionally, the second portion is capable of axial movement relative to the first portion. A load cell can be positioned between the first portion and the second portion to provide axial extension of the second portion to provide sufficient engagement force to couple the tug and barge.

48 Claims, 9 Drawing Sheets

APPARATUS FOR COUPLING TUG BOATS TO BARGES

FIELD OF THE INVENTION

This invention relates to the field of marine transport and more specifically to barge cargo transport. In particular, the present invention relates to connected or articulated tug and barge units, also known as articulated pusher boat and barge units.

BACKGROUND OF THE INVENTION

Articulated tug and barge units have long been used to transport various types of cargo in oceans, rivers, lakes and harbors. A conventional articulated tug and barge unit is commonly coupled together through the use of a ram assembly that extends from the tug into a cavity within a stern notch of the barge. As is shown if FIGS. 1 and 2, tug 14 enters stern notch 12 of barge 10. Vertical channels or receivers 18 are bilaterally mounted within stern notch 12. Upon entry into stern notch 12, a pair of axially aligned rams 16 are extended from opposite sides of tug 14 into channels 18 to provide a virtually unbreakable connection between tug 14 and barge 10. Limiting the relative movement between the tug and barge to only one degree of freedom upon coupling significantly reduces the potential for damage to both the tug and the barge and also increases the ability of the tug to control the barge. Therefore, most ram assemblies of the type shown in FIGS. 1 and 2 provide for relative pitch movement between the tug and the barge while at the same time preventing any relative roll and yaw movement between the tug and the barge.

One prior art ram assembly for mounting on tug 14 is shown in FIGS. 3 through 5. The operation of the particular coupling unit shown in FIGS. 3 through 5 is fully discussed in U.S. Pat. No. 4,688,507 to Kuhlman, et al., the disclosure of which is incorporated herein by reference. Referring to FIG. 3, each receiver or channel 18 is a cast member which is recessed into hull 20 surrounding stern notch 12 of barge 10 (FIG. 2). Each channel 18 has fore and aft walls which converge slightly as they extend inwardly. Flat base 26 connects the walls. Each wall is provided with a series of teeth which are spaced uniformly apart along the entire length of the channel. The teeth are equal in size and are uniformly spaced to balance the forces that are applied and minimize multiple angle planes of contact.

Coupling units 16, which are installed on the opposite sides of tug 14, are identical to one another. Each coupling unit includes cylindrical housing 30 formed of rolled steel plate and having a wall thickness sized to provide considerable strength and rigidity. A pair of circular mounting flanges 32 are welded or otherwise secured to the outer surface of housing 30 and are reinforced by gusset plates 34. Flanges 32 are welded or otherwise suitably connected in rigid fashion with hull 36 of tug 14. Flanges 32 can be suitably spaced to conform with the hull configuration. In this manner, each housing is mounted on the side of tug 14 with the open end of the housing facing outwardly.

Each housing 30 receives a ram which can be extended out of, and retracted into, the housing. Rams 38 are in axial alignment with one another. Each ram has a cylindrical wall which is preferably formed of steel. Ram 38 is carried in cylindrical bushing 40 which is fitted in the outer end portion of housing 30. The bushing provides a large bearing surface and permits the ram to extend and retract as necessary. Bushing 40 has a cavity which receives a packing arrangement 42 formed by a plurality of packing rings. The packing contacts housing 30 and ram 38 to prevent the entry of sea water and other contaminants.

As best shown in FIGS. 3 and 4, the leading or outer end of each ram carries a head which is formed by cast component 44 mounted on a solid steel ball. Ball 46 has neck portion 48 which is welded or otherwise secured to annular flange 50 projecting inwardly from the wall of ram 38. A plurality of gusset plates 52 serve to reinforce ram 38 and its connection with the head.

The opposite sides of head 44 are tapered to conform with the taper of the fore and aft walls of channel 18. The tapered sides of the head are each provided with a plurality of teeth having the same size and spacing as the teeth on the walls of the channel. When the head of each ram is extended into the channel, ram teeth 54 mate with the channel teeth to prevent the heads of the rams from moving vertically within the channels.

Head 44 is mounted on ball 46 for limited pivotal movement about mutually perpendicular axes. Ears 56 project outwardly from flange 50 and receive axially aligned guide pins 58 which are secured to the ears by screws 59. Guide pins 58 project inwardly from ears 56 and are received in bushings 60. Bushings 60 are in turn closely received in slots 62 which are formed in the top and bottom portions of head 44 and which are generally parallel to the ram axis. Split retainer ring 64 retains head 44 on ball 46 and is secured to the head by screws 66.

Guide pins 58 establish a vertical axis about which head 44 can pivot in limited fashion on ball 46. The inside surface of head 44 contacts beveled surfaces 70 on the front face of ball 46 to limit the pivotal movement of the head in both directions about pins 58. The fit of bushings 60 in slots 62 permits head 44 to similarly pivot in limited fashion about a horizontal axis. The front face of ball 46 is provided with beveled surfaces 70 which limit the extent to which head 44 can pivot on the ball about the horizontal pivot axis. Both the horizontal and vertical pivot axes for the head pass through the center of ball 46. The close fit of bushings 60 in slots 62 assures that the head cannot rotate on the ball about an axis coincident with the longitudinal axis of ram 38. Consequently, rotational movement of ram 38 about its axis is transferred by guide pins 58 to the head 44. Lubrication passages 72 extend through ball 46 to provide lubrication.

Ram 38 is extended and retracted by a large, solid, actuator shaft or screw 74 having external threads 76. Screw 74 extends along the axis of ram 38 and is supported for rotation by roller bearings 78 and 80 and by a large spherical roller thrust bearing 82 which receives the end of the actuator screw. Bearings 80 and 82 are located adjacent to one another and are retained within tail section 83 of gear box 84. Gear box 84 is secured to housing 30 and essentially forms a continuation thereof Circumferential flanges 86 and 88 are formed on the adjacent ends of gear box 84 and housing 30, respectively. The outer edge of retainer plate 90 is sandwiched between flanges 86 and 88. Plate 90 and flanges 86 and 88 are secured together by screws (not shown) or in any other suitable manner. Bearing 78 is mounted to retainer plate 90.

With reference to FIG. 4 in particular, actuator screw 74 extends through ring 92 having internal threads that mate with external threads 76 of the screw. Ring 92 is formed as an integral part of ram 38 and is connected with the wall of the ram by a pair of apertured plates 94. Actuator screw 74 is received within steel tube 96 which is secured to and projects outwardly from ring 92.

Actuator screw 74 is driven in normal operation by a pair of electric motors, 98 and 100. Motor 98 is a low speed, high torque motor mounted on platform 102 secured to gear box 84. Motor 100 is a high speed, low torque motor mounted on platform 104 secured to the gear box 84.

Low speed motor 98 drives gear reducer 105 having output shaft 106 which connects through pneumatic clutch 108 with pinion 110. Pinion 110 is supported by bearings 112 and drives larger gear 114 which is mounted on the same shaft as pinion 116. Bull gear 118 is mounted on actuator screw 74 and is driven by pinion 116.

Also connected with pinion 110 are a pair of air motors, 119 and 120, which are used for emergency extension and retraction of the ram. Line 124 leads to fitting 126 which supplies air to the clutch. Also connected with pinion 110 is ratchet handle 128 (shown in phantom) which is accessible so that it can be operated manually to rotate pinion 110 in either direction to thereby either extend or retract ram 38. Handle 128 preferably connects with pinion 110 through a conventional ratchet mechanism.

High speed motor 100 includes output shaft 130 which is connected by coupling 132 with pinion 134. Pinion 134 is supported for rotation by bearings 136. Pinion 134 mates with and drives bull gear 118 which is mounted on the actuator screw.

Thrust bearing 82 rests on load cell 138 which senses the load that is applied to actuator screw 74 during extension of ram 38. Load cell 138 is enclosed within tail section 83 of box 84 and engages cover plate 140 of the tail section. The moving parts of coupling unit 16 are provided with lubricant by lubricant pump 142 (see FIG. 4). Supplying lubrication to various portions of the ram assembly is often difficult due to the axial and rotational movement of the ram.

An internally threaded lock nut 144 is threaded onto actuator screw 74 at a location between bearing 78 and ring 92, as best shown in FIGS. 4 and 5. Lock nut 144 is provided with diametrically opposed lugs 146 which are pivotally connected with the rod ends of a pair of pneumatic cylinders 148. Cylinders 148 control lock nut 144 and are pivotally connected at their base ends with ram 38. When the cylinders are retracted, they tighten lock nut 144 against ring 92 and thereby serve as a ram retraction brake to prevent actuator screw 74 from rotating relative to ring 92, thereby preventing axial movement of the ram. When pneumatic cylinders 148 are extended, they loosen lock nut 144 by threading it away from ring 92. In this condition, actuator screw 74 can be rotated relative to the ring 92, thereby permitting axial movement (extension/retraction) of the ram.

The retraction brake can be activated when it is desired to rotate the ram along with the screw. Such rotation of the ram is often necessary to align ram head 44 with channel 18. When the retraction brake is activated, the ram will rotate with rotation of screw 74; the ram will not move axially with respect to the screw during such rotation.

When ram 38 is fully retracted, it trips limit switch 150 having projecting switch arm 152 engaged by the end of the ram in the fully retracted position. A similar limit switch (not shown) is tripped when ram 38 reaches its fully extended position. Another pair of limit switches, 154 and 156 (see FIG. 5), are tripped when ram 38 is rotated in one direction or the other beyond a limiting position relative to housing 30. If ram 38 is rotated in a counterclockwise direction beyond the limiting position, a projecting switch arm of switch 154 is tripped by plate 158 mounted on housing 30. Conversely, if the ram is rotated in housing 30 beyond a limiting position in the clockwise direction, the switch arm of switch 156 is tripped by plate 158. Housing 30 is provided with side access hatches which are normally covered by removable hatch covers 160 secured by screws 161. When hatch covers 160 are removed, access is provided through the exposed hatches to the interior of housing 30 for inspection and/or servicing of the internal components.

The manner of coupling tug and barge units just described provides a secure, dependable interconnection between a tug or pusher boat 14 and barge 10 and offers far greater control and maneuverability over a barge than the previously used methods of attaching tow cables to barges and pulling them through the water. Additionally, the use of a screw type ram assembly provides a much more reliable connection than that of hydraulic extension which is subject to catastrophic failure. Once the connection between tug 14 and barge 10 is achieved, the boat and barge unit is virtually inseparable and capable of tolerating very rough sea conditions. One report on the device shown in U.S. Pat. No. 4,688,507 indicated that a boat and barge unit coupled by such a device withstood and traveled through a storm having swells in excess of 35 feet.

While this report indicates the strength and durability of this type of extended screw ram assembly to connect a boat to a barge, it will also be appreciated that this type of assembly is quite expensive to manufacture and install on a tug, and adds a considerable amount of weight to the tug.

In the ram assembly of the prior art, high speed motor 100 and low speed motor 98 are used in combination to facilitate the connection between tug 14 and barge 10. When ram assembly 16 is under relatively low load conditions, such as during retraction and during unloaded extension (i.e., prior to contact between head 44 and channel 18), high speed motor 100 is utilized. When ram assembly 16 is subjected to relatively high load conditions, such as when ram head 44 is tightened up against the walls of channel 18 to provide a secure connection, low speed motor 98 will be utilized. An automatic control system that is connected to load cell 138 responds to changes in load on actuator screw 74 to alternate the use of high speed motor 100 and low speed motor 98. The control system energizes one motor, while declutching the other motor. The inclusion of two separate motors and an automatic control system add to both the expense and overall weight of the ram assembly. Therefore, it would be advantageous to provide a ram assembly that eliminates the need for two separate motors.

Another drawback of the prior art just described is that when the ram assembly is extended and brought into tight engagement with channel 18, actuator screw 74 is subjected to a considerable amount of torsion. The torsional force is created by low speed motor 98 which rotates actuator screw 74 to extend ram 38, providing an axial engagement force between the tug and barge. The torsional force is intensified as many tugboat operators tend to increase the engagement force between ram head 44 and the walls of channel 18 to curtail noises caused by slight movements between the respective surfaces of head 44 and channel 18. As the torque applied to actuator screw 74 increases, so does the wear on the components of ram assembly 16. Therefore, it would be advantageous to provide a ram assembly that produces sufficient engagement force without subjecting the actuator screw to substantial torsional forces.

Another disadvantage of the above described ram assembly is present in the design of the ram retraction brake, discussed above. The prior art retraction brake is somewhat complicated, including lock nut 144, cylinders 148 and associated controls, adding to the expense of the assembly.

Additionally, engagement of the retraction brake creates continuous torque on actuator screw 74 and causes actuator screw 74 to rotate as ram 38 rotates to the pitch motion of the tug. The continuous torque increases the amount of wear on the actuator screw. The rotation of the actuator screw results in a rotating interface through which the engagement force of ram assembly 16 is transferred from the actuator screw to the hull of the tug boat, thereby increasing wear on the components of the ram assembly. Additionally, the rotation of the actuator screw requires disengagement or declutching of the motors to reduce inertia. Therefore it would be advantageous to provide a ram assembly having a less complicated and non-rotating retraction brake.

SUMMARY OF THE INVENTION

The present invention comprises an improved coupler assembly for establishing engagement between a tug or pusher boat and a barge which eliminates many of the disadvantages of the prior art.

It is an important object of the present invention to provide an affordable and lightweight mechanical coupling assembly which has a sufficiently rugged construction to withstand the considerably rugged forces that are encountered. The heavy duty construction of the coupler maintains a positive and secure tug to barge connection under even the worst conditions, thereby eliminating the possibility of hull contact and other dangerous situations.

It is another object of the present invention to provide an affordable and lightweight coupling assembly that significantly reduces the drive force, or torque, necessary to engage properly the tug-mounted ram assembly with the barge.

It is yet another object of the present invention to provide a simplified retraction brake for the coupling assembly which is non-rotating.

One other object of the instant invention is to eliminated the need in the prior art to use the screw drive to rotate the ram for alignment of the ram head with the barge channel.

The above objects are accomplished through an extending screw type coupling assembly that includes a two-portion ram associated with the screw, and a load cell associated with the screw. As described above with reference to the prior art, the coupling assembly of the instant invention includes a pair of axially aligned ram assemblies mounted to a pusher boat. The pusher boat is navigated into a stern notch of a barge. The rams of the ram assemblies are extended into channels or cavities bilaterally positioned within the stern notch through rotation of actuator screws connected to the rams. As the rams come into engagement with the barge, extension of the rams through rotation of the actuator screws is terminated. The load cell of each assembly is then activated to provide the engagement force necessary to securely couple the tug and barge.

The ram component of each assembly comprises two portions. The first portion of the ram, which is the drive brake portion, is in threaded connection with the actuator screw. The drive brake portion of the ram assembly works in combination with the screw to prevent axial movement of the ram assembly, and to transfer the engagement force from the ram through the screw and ultimately to the tug hull upon engagement of the ram with the barge. As an axial force is applied to the ram by engagement with the barge, a motor brake, or other suitable screw brake, will prevent any rotation of the screw that might be caused by the engagement force; thus working in combination with the screw and the drive brake portion of the ram assembly to act as a drive brake for the entire assembly. The second portion of the ram, the piston portion, is capable of rotational movement relative to the drive brake portion.

The instant invention is referred to as a drive brake because rotation of the screw drive is terminated to activate the brake. As opposed to the prior art retraction brake discussed above, the to inventive drive brake is positive in that when activated it will statically prevent axial movement of the ram. When the actuator screw is rotated, the drive brake portion of the ram will move axially along the screw to extend and retract the ram; when the rotation is discontinued, axial movement of the drive brake portion of the ram is eliminated. The drive brake of the instant invention eliminates the need for a complicated control system and associated dynamic locking structure, reducing both the cost and weight of the assembly.

Because the drive brake is non-rotating, and the piston portion is rotatable with respect to the drive brake portion, relative pitch movement between the tug and barge is permitted without resulting in rotation of the actuator screw or drive of the ram assembly. This eliminates the need to declutch the drive motor to reduce inertia and results in a non-rotating drive to hull load transfer interface. Additionally, the non-rotating drive brake and rotating piston combination eliminates the torque forces on the actuator screw that are constantly present during engagement of the prior art retraction brake, reducing the wear on the ram assembly components.

Several embodiments of the instant invention are provided showing several possible locations of the load cell. In each of these embodiments the load cell works in combination with the actuator screw to provide engagement of the tug and barge. The actuator screw extends the ram into the channel on the barge; this alone will provide a secure connection between the tug and barge that can withstand a substantial amount of exterior forces incurred during tug-barge connection. Once the ram assembly has been extended into the barge channel, the load cell is activated to provide a tight engagement force between the tug and barge, thus increasing the strength of the tug-barge connection and minimizing the possible noise of the connection. The primary purpose of the load cell is to provide an engagement force rather than axial movement of the ram, thus the actual axial movement of the ram assembly caused by the load cell will be minimal. In this way catastrophic decoupling of the tug and barge is prevented in the event the load cell is depressurized because the actuator screw will maintain the connection.

In one embodiment of the instant invention, the axial movement of the ram assembly is accomplished through the use of a load cell positioned between the drive brake and the piston portions of the ram assembly. As the load cell is activated, the piston is forced away from the drive brake, forcing the piston into tight engagement with the barge. In another embodiment of the instant invention, the load cell is positioned between the housing of the assembly and the actuator screw. In this embodiment, as the load cell is activated, the actuator screw is forced to move axially with respect to the housing. As the actuator screw moves axially, so does the ram assembly through the movement of the screw.

The two piece construction of the ram, combined with the load cell, eliminates the prior art requirement for low speed motor 98 to extend ram 38 into tight engagement with the barge. Elimination of one of the two motors and all drive clutches results in substantial production cost savings and weight reduction, as well as elimination of the torsional engagement forces to which the actuating screw is subjected during engagement.

One other disadvantage of the prior art assembly that is overcome by the present invention is the need for a tensioning assembly to extend and retract lubrication lines and control cables that attach to the ram. Because the entire ram assembly of the prior art, including the retraction brake and actuator screw, is rotatable upon engagement with the barge, a tensioning mechanism is necessary to prevent binding of the lines and cables during rotation. This tensioning mechanism adds considerable weight and expense to the coupler assembly. The drive brake of the instant invention provides a non-rotatable mount for lubrication lines and control cables, eliminating the risk of binding and thus the need for a tensioning mechanism.

Another optional feature of the instant invention is the inclusion of a passage extending axially through the screw. In the instant invention the passage is used to provide lubrication to the ram assembly; however, the passage could be used for other purposes, such as providing connection of control lines to the ram. The instant invention utilizes an expandable tube for carrying the lubrication through the passage. The preferred embodiment of this tube is telescoping. This allows the tube to be both axially expandable as well as rotatable. Other forms of lubrication tubes may be utilized in the instant invention; however such may require additional mechanisms for extension and retraction of the tubes.

The foregoing and other objects are intended to be illustrative of the invention and are not meant in a limiting sense. Many possible embodiments of the invention may be made and will be readily evident upon a study of the following specification and accompanying drawings comprising a part thereof Various features and sub combinations of invention may be employed without reference to other features and sub combinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

Preferred embodiments of the present invention are hereinafter described with reference to the accompanying drawings.

Figure 1:
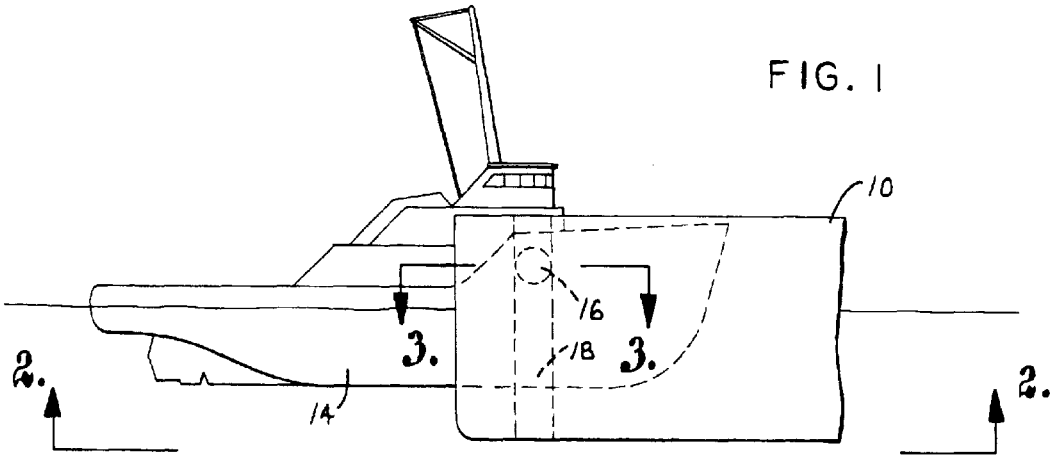
FIG. 1 is a side elevation view showing a tug coupled to a barge by the coupler assembly of the present invention, with the barge being shown only fragmentarily.
Figure 2:
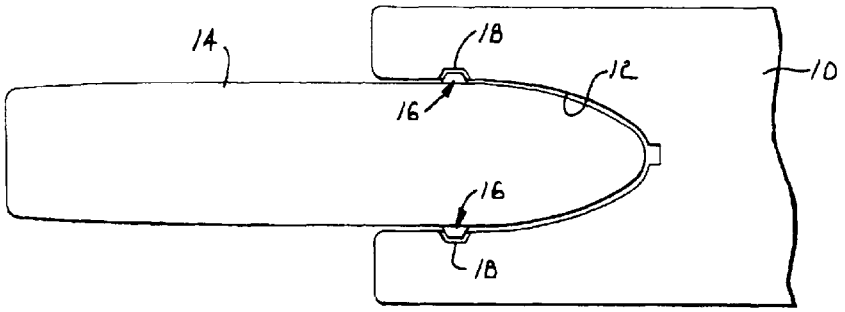
FIG. 2 is a bottom plan view taken generally along line 2—2 of FIG. 1 in the direction of the arrows.
Figure 3:
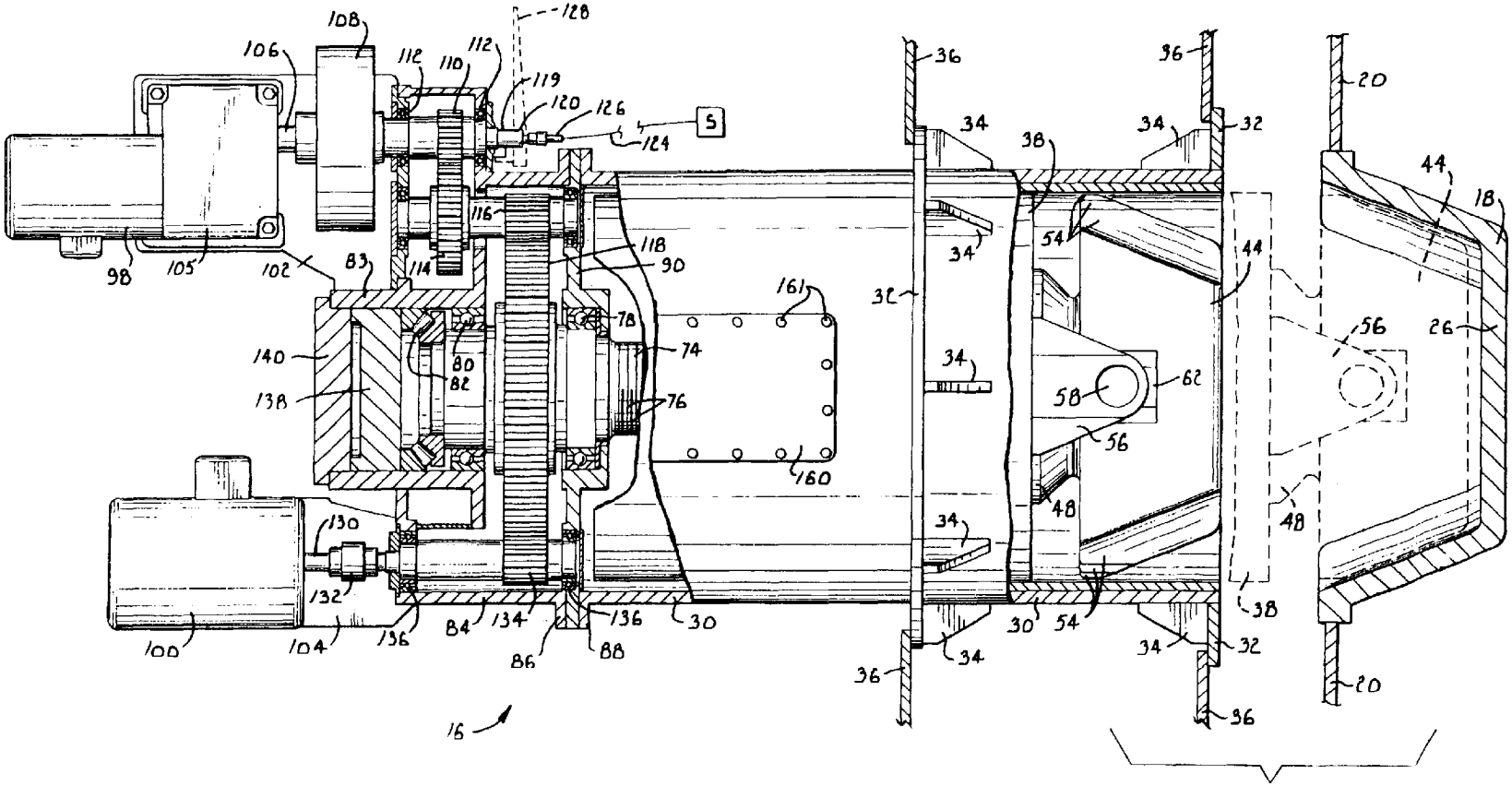
FIG. 3 (PRIOR ART)
FIG. 3 is a fragmentary cross-sectional view on an enlarged scale taken generally along line 3—3 of FIG. 1 in the direction of the arrows and showing a prior art coupling assembly with portions broken away for purposes of illustration, and the broken lines showing the extended position of the ram of the coupling assembly.
Figure 4:
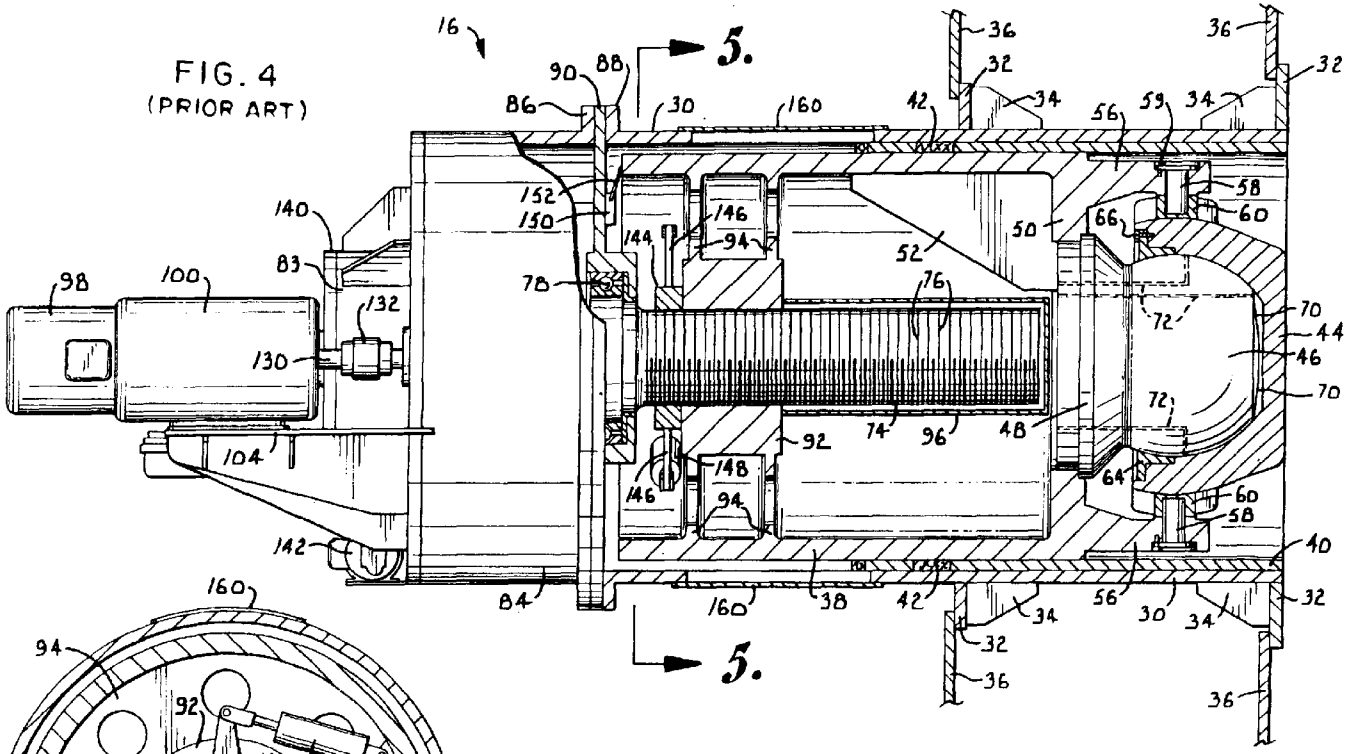
FIG. 4 (PRIOR ART)
FIG. 4 is aside elevation view, partially in section of the prior art coupling assembly shown in FIG. 3.
Figure 5:
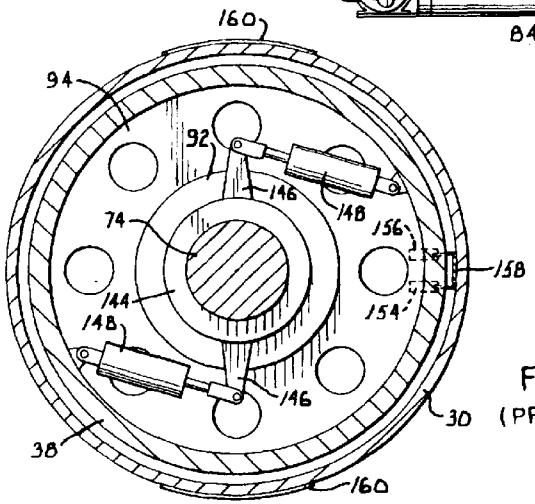
FIG. 5 (PRIOR ART)
FIG. 5 is across-sectional view taken generally along line 5—5 of FIG. 4 in the direction of the arrows.

The operation of the inventive coupler assembly is substantially similar to that of the prior art assembly discussed above with reference to FIGS. 1 and 2. As discussed above, each side of tug 14 is equipped with an identical coupler assembly. Coupler assemblies 16 are mounted to tug 14 to be in axial alignment with one another. In operation, tug 14 is navigated into stern notch 12 of barge 10; the rams are then extended from the coupler assemblies into channels or receivers 18 which are bilaterally mounted within stern notch 12.

Like the prior art assembly, the instant invention utilizes an actuator screw to extend and retract each ram. As discussed above, the prior art assembly utilizes a low speed motor to provide a torque force which rotates an actuator screw; the torque force is translated into an axial force through the threaded engagement of the ram with the actuator screw. Contrasting the prior art assembly, the instant invention does not utilize a low speed motor to provide a torque force that is translated into the axial engagement force necessary to securely couple tug 14 to barge 10. Instead, the axial engagement force is achieved through the use of a load cell that provides a direct axial force.

Channels 18 discussed herein with respect to the instant invention are similar to the prior art channels of Pat. No. 4,688,507. Nevertheless, the coupler assembly of the instant invention can utilize variations of the described assembly, or any other suitable configuration. For instance, the channel assemblies can be made vertically repositionable as disclosed in U.S. Pat. No. 6,199,501 to Kuhlman, incorporated herein by reference. This inventor's U.S. patent application Ser. No. 09/929,403, filed on Aug. 14, 2001, discloses one alternative configuration for channel assembly 18. As is disclosed in U.S. patent application Ser. No. 09/929,403, certain configurations of the channel assembly, may also require alternative configurations of the ram head to correspond to the alternative channel configuration.

Figure 6:
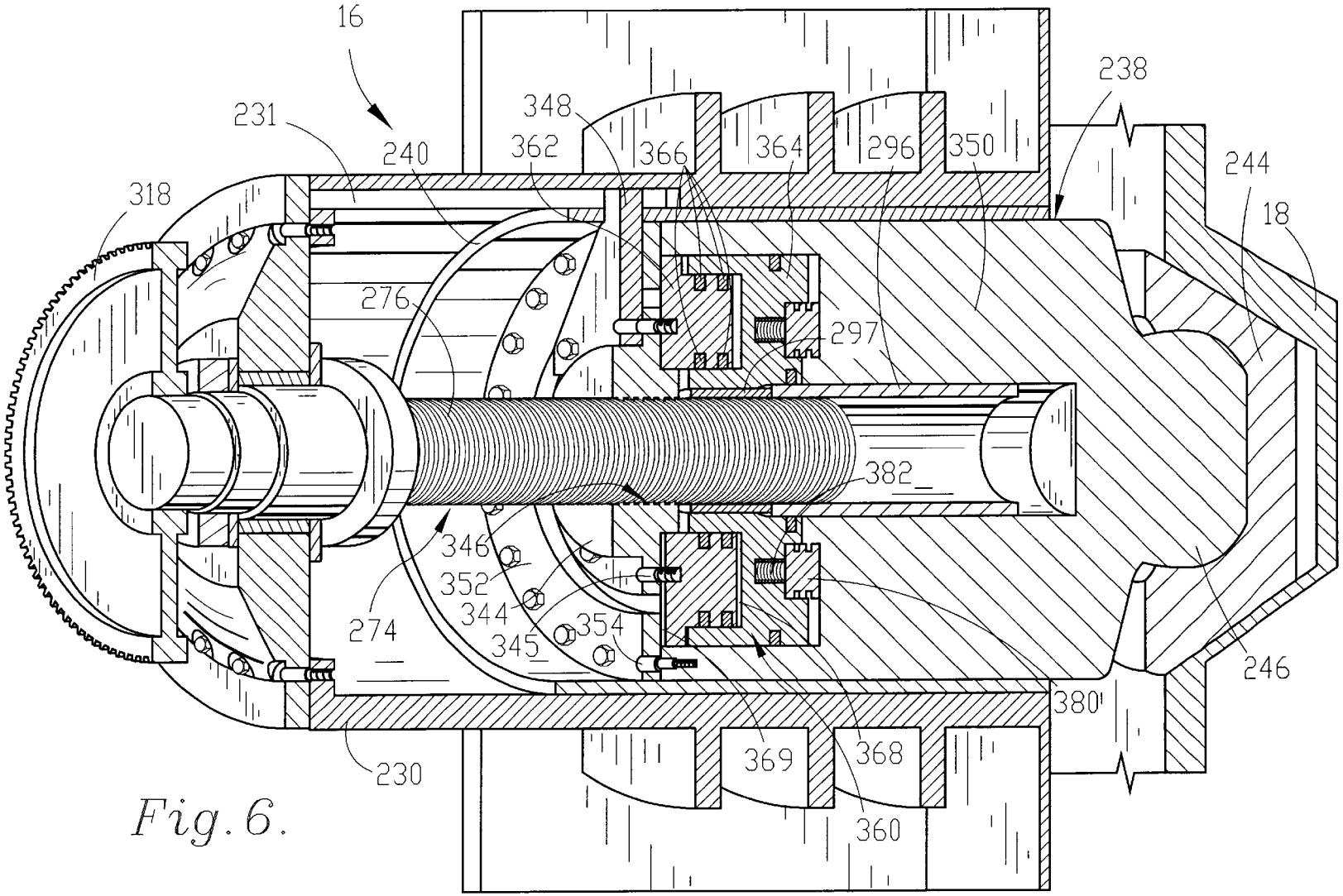
FIG. 6 is a cross-sectional perspective view on an enlarged scale taken generally along line 3—3 of FIG. 1 in the direction of the arrows and showing a first embodiment of the coupling assembly of the instant invention in the extended position.
Figure 7:
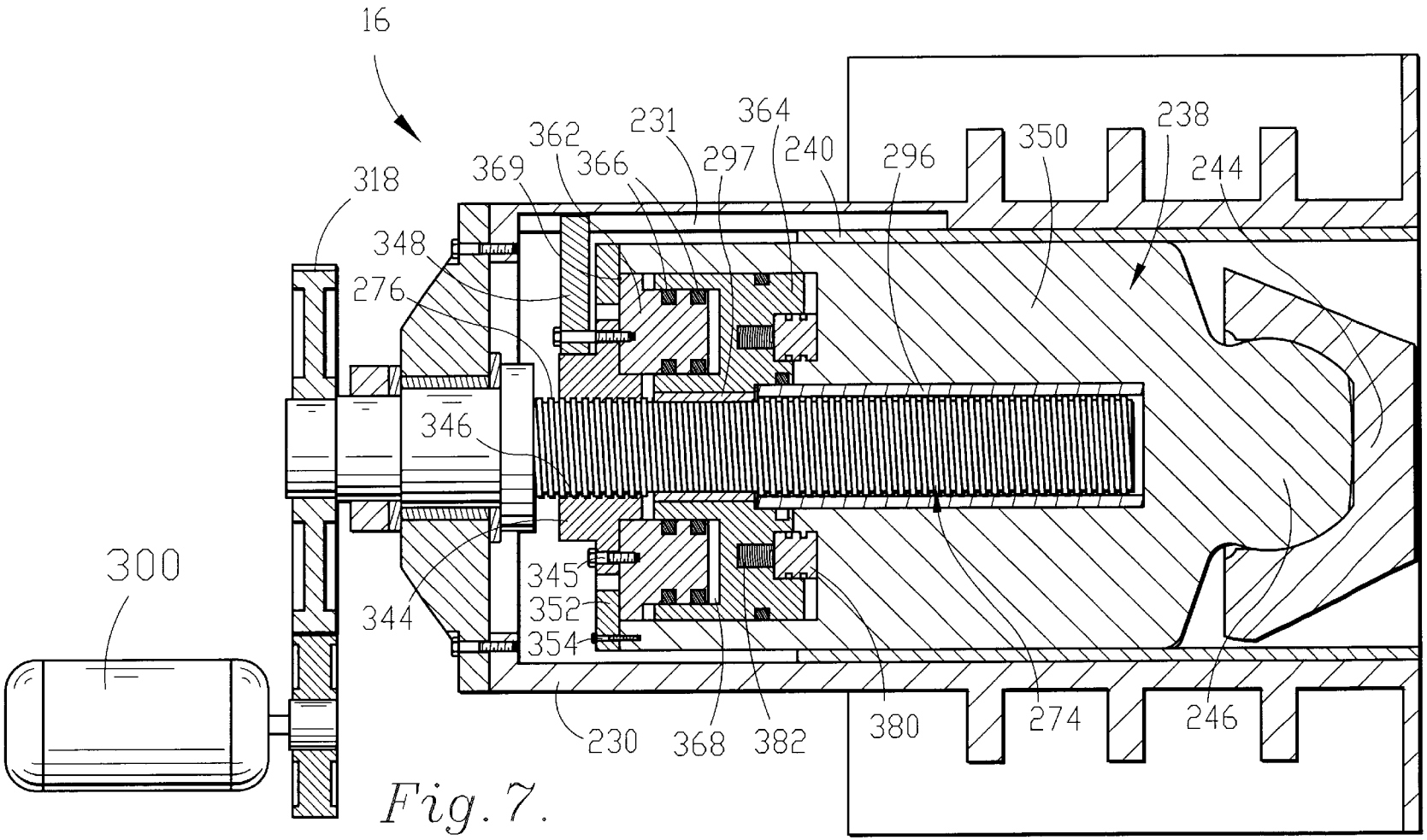
FIG. 7 is a cross-sectional view taken generally along line 3—3 of FIG. 1 in the direction of the arrows and showing the first embodiment of the coupling assembly of the instant invention in the retracted position.
Figure 8:
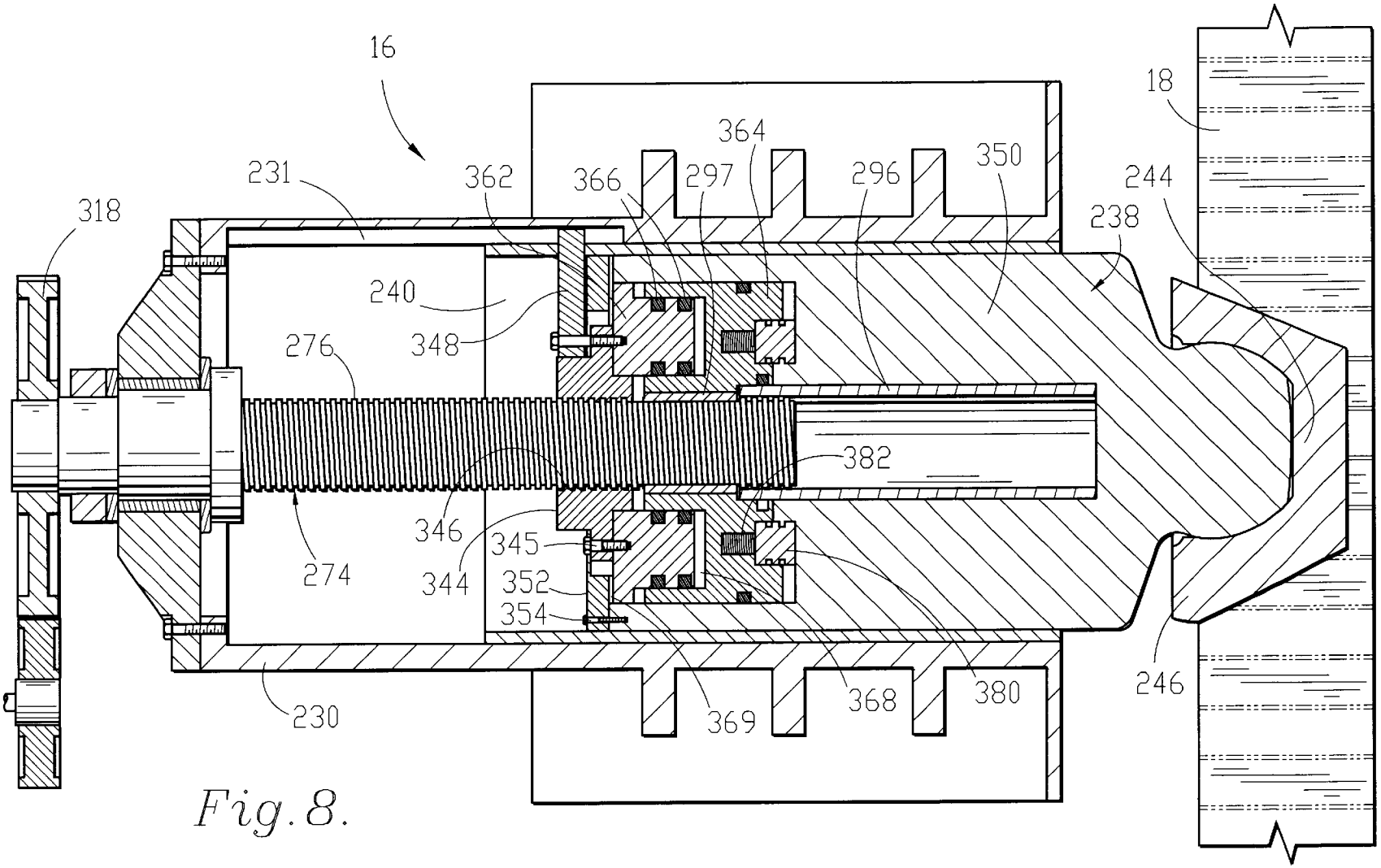
FIG. 8 is a cross-sectional view taken generally along line 3—3 of FIG. 1 in the direction of the arrows and showing the first embodiment of the coupling assembly of the instant invention in the extended position.

FIGS. 6 through 8 show a first embodiment of coupling units 16 which are identical to one another and installed in axial alignment with one another on the opposite sides of tug 14. Each coupling unit includes cylindrical housing 230 that is formed in the same manner and of the same materials as the housing of similar prior art devices. The instant invention includes groove 231 extending axially along a portion of the inner wall of housing 230. As is well known in the art, each housing is mounted on the side of tug 14 with the open end of the housing facing outwardly from the tug.

Each housing 230 receives a two-part ram assembly 238 which can be extended out of and retracted into the housing. Each ram assembly 238 is formed in a similar manner and of similar materials as the ram of the prior art. As in the prior art coupler assembly, ram assembly 238 has a cylindrical wall which is preferably formed of steel. Also like the prior art, ram assembly 238 is carried in cylindrical bushing 240 which is fitted in the outer end portion of housing 230. Axial groove 231, which extends through housing 230, also extends through bushing 240 of the instant invention.

Ram 238 is primarily extended and retracted by a large actuator shaft or screw 274 having external threads 276. Screw 274 is supported for rotation within housing 230 and extends along the axes of ram assembly 238 and housing 230. Drive gear 318 is mounted on actuator screw 274. Electric motor 300 rotates drive gear 318 to effect rotation of the actuator screw. Electric motor 300 includes a motor brake to prevent unwanted rotation of the actuator screw when the motor is not being operated. The motor brake is a portion of the drive brake which prevents rotation retraction of the ram assembly upon application of an axial force.

A significant difference between the ram assembly of the prior art and that of the instant invention is the fact that ram assembly 238 is a two-part assembly, including a first drive portion and a second piston portion associated with the first portion. A two-part assembly creates several features which may be utilized either in combination or individually. One feature is that the first portion can be non-rotatable, with the second portion rotatable with respect to the first portion. Another feature is that the second portion can be capable of axial movement with respect to the first portion. The first embodiment of the instant invention utilizes both the axial and rotational movement features of the two-part ram assembly. In the first embodiment, ram assembly 238 includes a first portion, drive brake portion (or retraction restriction portion) 344, and a second portion, piston portion 350.

Drive brake portion 344 of the ram is a screw nut that includes internal threads 346 which correspond to and mesh with external threads 276 of the actuator screw. As actuator screw 274 is rotated, screw nut 344 extends and retracts axially along threads 276. Anti-rotation pin 348 is connected to nut 344 and extends into axial groove 231 of housing 230. Anti-rotation pin 348 can be an integral component of drive brake portion 344, or a bolt (not shown) can be inserted into one of brake apertures 345 to secure pin 348 to brake portion 344. Pin 348 is slidably engaged with groove 231 to permit axial movement of screw nut 344 relative to the housing, while simultaneously restricting rotational movement of the screw nut relative to the housing.

Cylindrical piston portion 350 of the ram assembly includes bushing 296 to receive actuator screw 274. Bushing 296 extends axially through the center of piston portion 350, permitting both axial and rotational movement of the piston portion relative to screw 274 and independent of threads 276. The outer circumferential surface of piston portion 350 contacts bushing 240. Extraction ring 352 is connected to the outer circumference of the inner end of piston portion 350. Extraction ring 352 can be an integral part of piston portion 350, or the ring can be connected to the piston portion with bolts (not shown) inserted through piston apertures 354. Solid steel ball 246 is located at the outer end of piston portion 350, to support helmet/head 244. Helmet 244 can be mounted to permit full pivotal movement about steel ball 246. Alternatively, anti-rotation pins can be included to limit the pivotal movement of helmet 244 as described above with respect to the prior art.

In the first embodiment, illustrated in FIGS. 6 through 8, annular load cell 360 is positioned between brake portion 344 and piston portion 350. The load cell includes load cell piston 362 and load cell cylinder or chamber walls 364. Load cell piston 362 fits within cylinder 364. In operation, load cell 360 is pressurized as hydraulic fluid is pumped into chamber volume 368 to force axial separation between load cell piston 362 and cylinder 364, thus increasing chamber volume 368. Pressure seals 366 are located between load cell piston 362 and cylinder 364 to prevent the hydraulic fluid from escaping chamber volume 368. The hydraulic fluid is supplied to the load cell via hydraulic lines (not shown) that are connected to screw nut 344 and hydraulic passageways (not shown) that extend through the screw nut and on through load cell piston 362 into chamber volume 368.

In the first embodiment of the instant invention, load cell piston 362 is rigidly connected to screw nut 344 preventing rotational movement of load cell 360 and preventing axial movement of the load cell piston relative to the screw nut. Thus, as load cell 360 is operated to increase the volume of chamber volume 368, cylinder 364 is forced axially away from both piston 362 and screw nut 344. Piston portion 350 of ram 238 is connected to cylinder 364 such that as cylinder 364 is forced away from screw nut 344, so too, is piston portion 350. Bushing 297 is located between actuator screw 274 and cylinder 364 to allow for axial movement of the cylinder relative to screw 274 and independent of threads 276.

Annular thrust bearing 380 is positioned between cylinder 364 and ram piston portion 350 to allow for rotation of the ram piston relative to cylinder 364. Coil springs 382 are positioned between rotational thrust bearing 380 and cylinder 364 to provide a constant axial load on the thrust bearing, and thus prevent separation of thrust bearing 380 during retraction of the ram assembly. In the illustrated embodiment, coil springs 382 are spaced at sixty degree increments around the circumference of thrust bearing 380 to provide an even axial load on the bearing.

The outer circumference of ram piston 350 extends axially towards the inner end of housing 230 surrounding load cell 360 and creating axial gap 369 between the inner end of load cell piston 362 and extraction ring 352. The size of gap 369 is dependent upon the amount of axial travel that is desired between ram piston 350 and screw nut 344. Extraction ring 352, which is connected to the inner end of ram piston 350, extends radially inward of ram piston 350 to radially overlap a portion of load cell 360 which extends radially outward of screw nut 344. Anti-rotation pin 348 extends radially outward from screw nut 344 axially inward of extraction ring 352, therefore, sufficient axial spacing must be provided between pin 348 and ring 352 to allow for the axial travel of ring 352 relative to screw nut 344.

Lubrication passages (not shown) extend through ram assembly 238 to provide lubrication to the dynamic components of the assembly.

The operation of coupler assembly 16 of the first embodiment of the instant invention will now be described in which ram assembly 238 is fully retracted and load cell 360 is depressurized. Both axially aligned coupler assemblies 16 (one on each side of tug 14) will operate simultaneously in an identical manner to properly couple tug 14 to barge 10, therefore, the operation of a single it coupler will now be described. Motor 300 drives gear 318 to rotate actuator screw 274. As actuator screw is rotated in a first direction, screw threads 276 engage with screw nut threads 346 to move screw nut 344 and ram assembly 238 in an outwardly axial direction relative to housing 230. As discussed above, load cell piston 362 is rigidly connected to the screw nut, thus, load cell piston 362 will travel in conjunction with screw nut 344. Because the load cell is depressurized, chamber volume 368 reduces toward zero as the load cell piston travels in an outwardly axial direction. As chamber volume 368 decreases, gap 369 will correspondingly increase (see FIG. 7). Load cell piston 362 pushes load cell cylinder 364 in an outwardly axial direction, which in turn pushes ram piston 350 in an outward direction to extend ram 238.

As helmet 244 of ram piston 350 contacts channel 18, rotation of actuator screw 274 is terminated. Once the helmet of each axially aligned ram 238 is in contact with its corresponding channel, each load cell 360 is pressurized to further extend rams 238 and provide sufficient engagement force to couple the tug and barge. As ram 238 is extended by pressurization of load cell 360, gap 369 will decrease in relation to the increase of chamber volume 368.

It is important to note that the primary purpose of load cell 360 is to provide a minute axial extension of ram assembly 238 to provide sufficient engagement force to couple the tug and barge. Therefore, as each helmet is already in contact with its corresponding channel, the actual axial travel of piston portion 350 of each ram upon pressurization of the load cells will be minimal, or possibly even nonexistent. In this manner failure of each of the axially aligned ram assemblies will not result in catastrophic decoupling of the tug and barge.

When it is desired to decouple the tug and barge, the above described coupling process is reversed. Load cell 360 is depressurized, reducing chamber volume 368 and increasing gap 369. Actuator screw 374 is then rotated in the opposite direction causing screw nut 344 to move axially inward relative to housing 230. As screw nut 244 moves inward, so does load cell piston 362, which pulls away from cylinder 364 to increase chamber volume 368. As chamber volume 368 increases, gap 369 correspondingly decreases until the radially overlapping portions of load cell piston 362 and extraction ring 352 contact each other (see FIG. 8). Extraction ring 352 and connected ram piston 350 will then be forced to travel axially inward along with load cell piston 262, thereby retracting ram 238.

Figure 9:
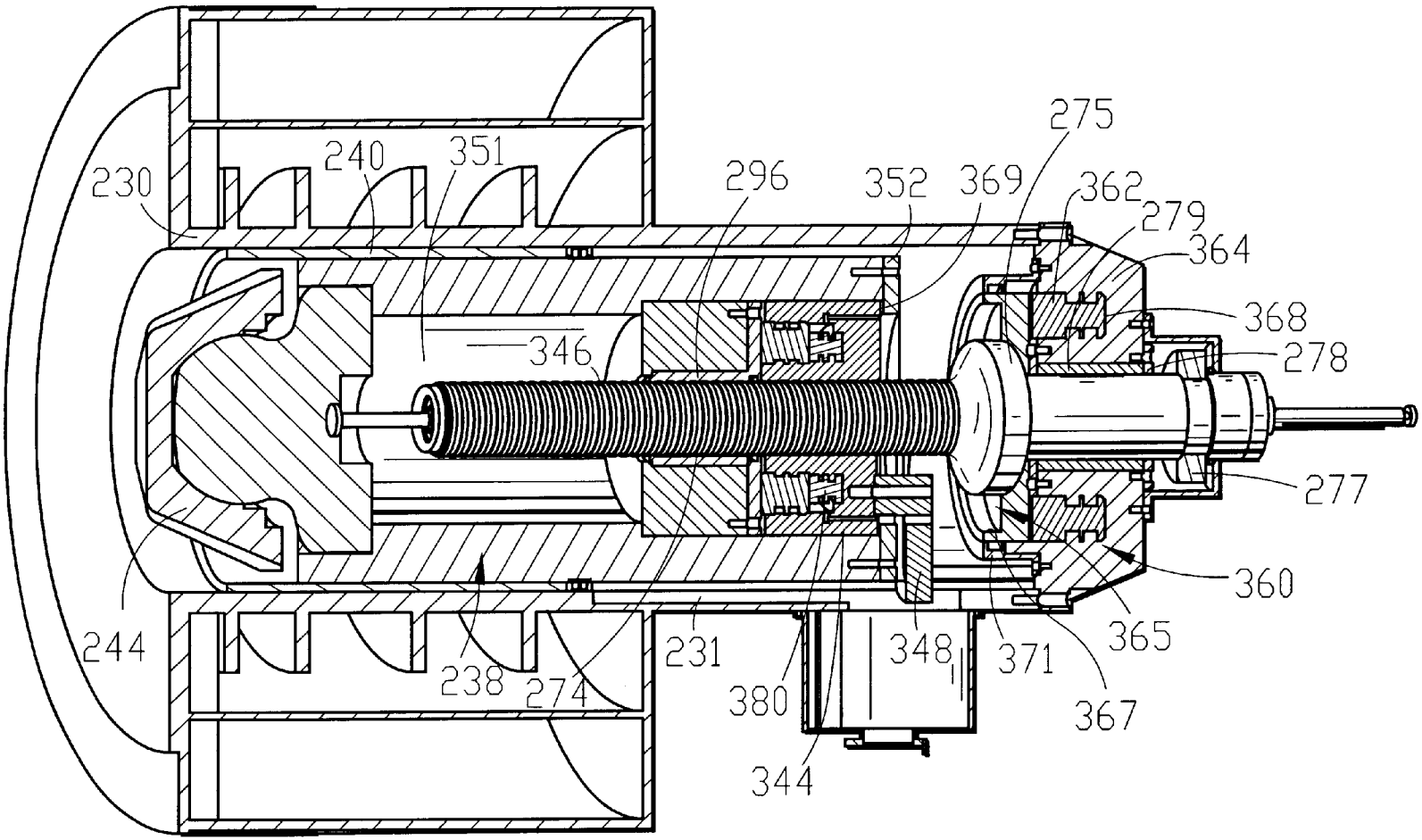
FIG. 9 is a cross-sectional perspective view on an enlarged scale taken generally along line 3—3 of FIG. 1 in the direction of the arrows and showing a second embodiment of the coupling assembly of the instant invention in the retracted position.
Figure 10:
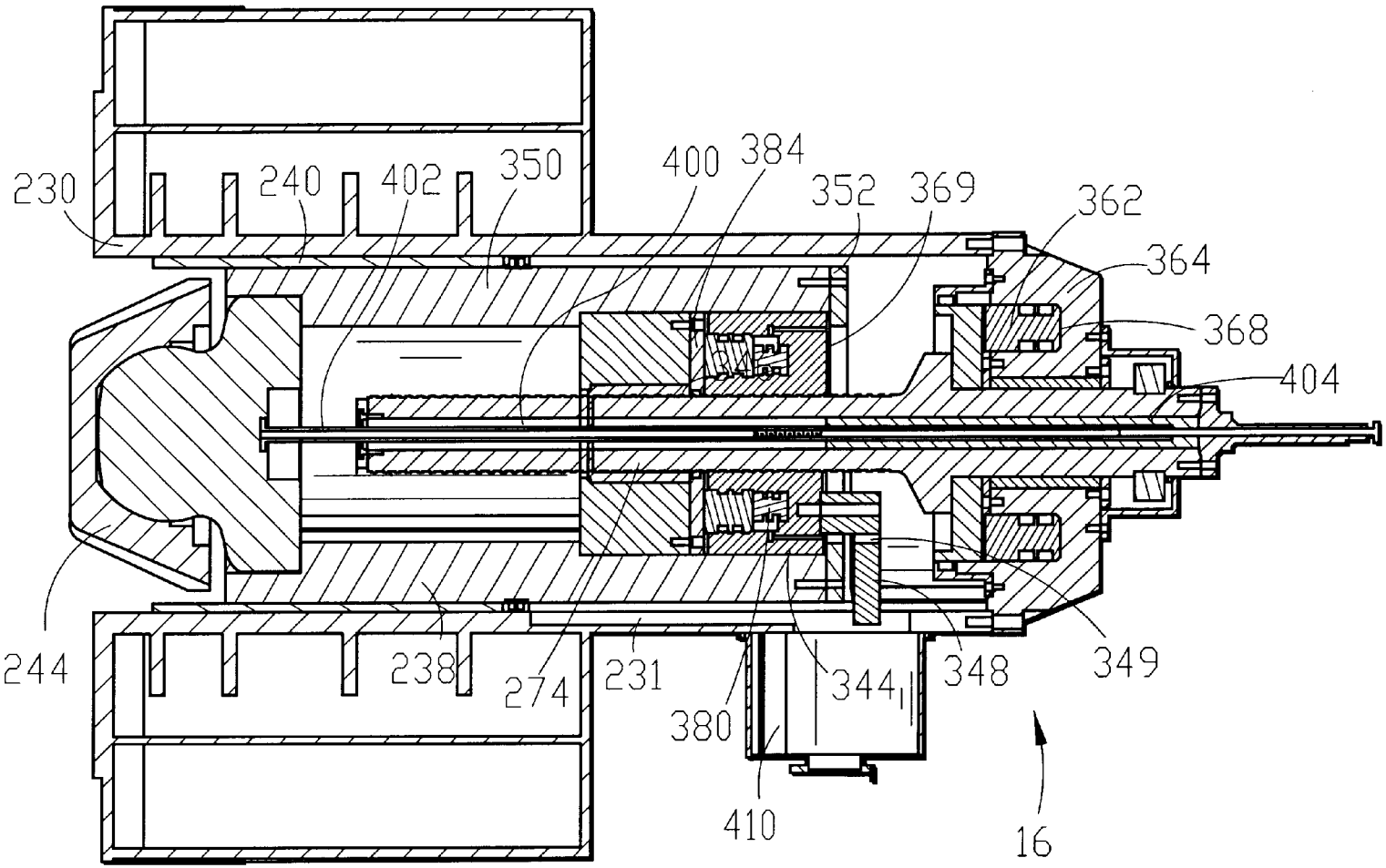
FIG. 10 is a cross-sectional view taken generally along line 3—3 of FIG. 1 in the direction of the arrows and showing the second embodiment of the coupling assembly of the instant invention in the retracted position.
Figure 11:
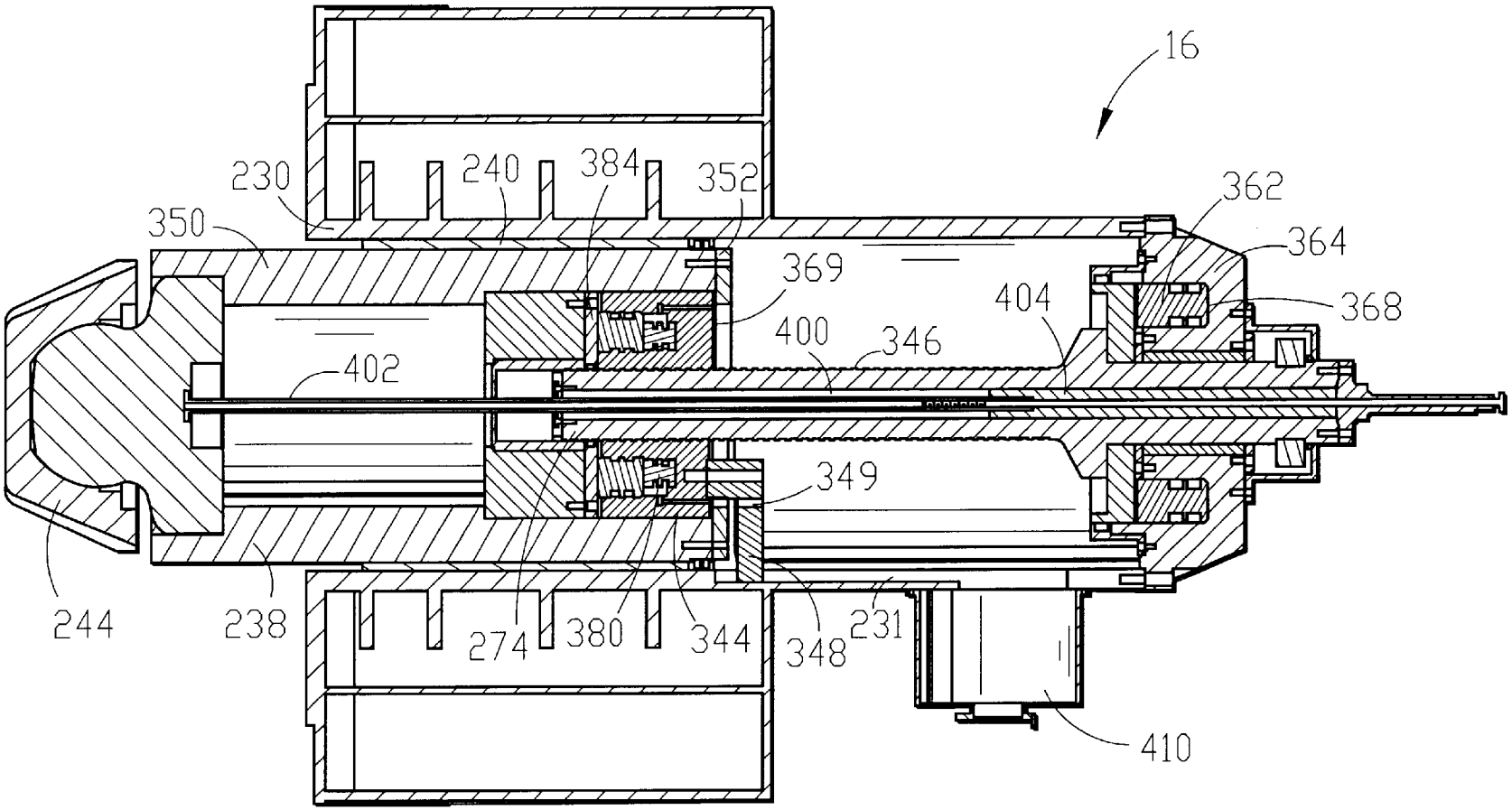
FIG. 11 is a cross-sectional view taken generally along line 3—3 of FIG. 1 in the direction of the arrows and showing the second embodiment of the coupling assembly of the instant invention in the extended position.

A second embodiment of the coupler assembly of the instant invention is shown in FIGS. 9 through 11 in which load cell 360 is positioned to provided axial movement of actuator screw 274 with respect to housing 230. In this manner, axial movement of ram assembly 238 is provided through the axial movement of the actuator screw. This embodiment operates and functions in virtually the same manner as the first embodiment discussed above, the primary difference being the location of the load cell.

Load cell 360 is positioned at the inboard end of housing 230 of coupler assembly 16. The load cell includes piston portion 362 and cylinder wall or chamber wall portion 364. Cylinder wall portion 364 of load cell 360 is statically connected to the inboard end of housing 230 of the coupler assembly. The outboard end of load cell piston 362 is associated with load cell thrust ring 365. Thrust ring 365 is in association with shoulder 275 protruding from screw 274. Steel housing 371 surrounds thrust ring 365, with the outward edge of steel housing 371 contacting thrust ring 365 to provide a seal for oil retention around thrust ring 365. Because steel housing 371 is stationary, and thrust ring 365 moves axially with respect to housing 230, lip 367 of thrust ring 365 is included to maintain constant contact between the outward edge of steel housing 371 and thrust ring 365 during operation of load cell 360.

The amount of axial extension of actuator screw 274 is limited by a retraction collar 277 which protrudes from screw 274. As the actuator screw is extended axially outward from housing 230, retraction collar 277 will contact retraction thrust bearing 278 which is attached to the housing of the coupler assembly. Maximum axial extension of the actuator screw may be accomplished either by activation of the load cell, or during retraction of the ram assembly by rotation of the actuator screw which will cause an outward axial force on the screw. During activation of the load cell, axial extension of the screw can also be limited by use of a control system including limit switches. Screw-shaft bushing 279 is located between housing 230 and the outer circumference of actuator screw 274 to support the actuator screw for both rotation and axial travel within the housing.

Ram assembly 238 of the second embodiment of FIGS. 9–11 is similar to that of the first embodiment except for the inclusion of the load cell within the ram assembly of the first embodiment. In FIGS. 9 through 11, ram assembly 238 includes non-rotatable, threaded drive brake portion (or screw nut) 344, rotational thrust bearing 380, and second portion (or piston portion) 350. Screw nut 344 includes anti-rotation pin 348 that travels axially within groove 231. Bushing 296 allows for rotation of piston portion 350 relative to actuator screw 274 and rotatable thrust bearing 380 allows rotation of piston portion 350 relative to screw nut 344. Bronze thrust plate 384 is included between bearing 380 and piston portion 350 to reduce wear on the assembly. A segment of piston portion 350 of the ram assembly radially surrounds the outer circumference of nut 344 and extends axially inboard of housing 230 beyond the inner portion of nut 344. Retraction ring 352 is connected to the inboard end of piston 350. The retraction ring extends radially inward to partially overlap a portion of nut 344. The outboard end of piston 350 is connected to helmet 244.

The primary functional difference between the first and second embodiments of ram assembly 238 is that the piston portion of the second embodiment, shown in FIGS. 9–11, is essentially not capable of axial movement relative to nut 344. In operation, actuator screw 274 is rotated by a motor and gearing connected to the outer end of the screw shaft. Coupling of the tug and barge begins with load cell 360 depressurized. As the screw is rotated in a first direction, screw nut 344 will be prevented from rotation by the association of anti-rotation pin 348 with axial groove 231. Thus, screw nut 344 will travel axially outward along the threads of actuator screw 274. Extension of the screw nut will urge piston 350 outward. When head 244 engages channel 18 of the barge, the motor operation will be terminated and a motor brake is activated to prevent further rotation of actuator screw 274. Load cell 360 is then pressurized urging load cell piston 362 outward.

As load cell 360 is pressurized, load cell chamber volume 368 increases and load cell piston 362 will extend axially away from the inboard end of the housing. Piston 362 will provide an axial force on thrust ring 365 which will in turn provide an axial force on screw shoulder 275. This axial force results in axial extension of the actuator screw and ram assembly and/or increased engagement pressure between the tug and barge. If the actuator screw extends axially outward beyond a maximum limitation, a limiting switch will be triggered and the load cell will be depressurized and the motor reactivated to further extend the ram assembly before the load cell is again reactivated.

During extension of the ram assembly by rotation of actuator screw 274, the actuator screw will be urged axially inward of the housing. Axial movement of the screw will be prevented by shoulder 275 which transmits the axially inward force from the screw to thrust ring 365, through load cell 360 and ultimately to the tug through housing 230. The engagement force of the ram assembly will be transmitted to the tug hull in the manner just described.

Decoupling of the barge is conducted in the reverse manner of coupling. The load cell is depressurized, the motor brake is deactivated and the motor is operated in a reverse direction to drive nut 344 axially inward of housing 230. Nut 344 will engage retraction ring 352 which pulls piston portion 350 inward along with nut 344, thus resulting in retraction of ram assembly 238. As the ram assembly is being retracted, screw 274 will tend to be pulled axially outward. This outward movement is prevented by collar 277 when it contacts retraction bearing 278.

Although piston portion 350 of the ram assembly of this embodiment is not capable of axial extension relative to screw nut 344, there will exist of small amount of axial play between piston 350 and nut 344. This play is permitted to aid in making the two portions of the ram assembly rotatable relative to one another. The play results in small gap 369 between retraction ring 352 and the radially overlapping portion of nut 344 when the ram assembly is extended. When the ram assembly is being retracted gap 369 will close up as nut 344 is driven inward.

In addition to the differing location of the load cell and its associated design characteristics, several features of the instant invention are shown in FIG. 9 through 11 that could be incorporated into either embodiment. For example, cylindrical bushing 240 shown in the second embodiment does not include an axial groove for association with the anti-rotation pin of the drive brake portion of the two-piece ram assembly. This is because the arrangement of bushing 240 and ram assembly 238 within housing 230 is such that the travel of anti-rotation pin 348 will not coincide with bushing 240. Another feature shown in FIGS. 9 through 11 is hollowed central region 351 of ram piston portion 350. This allows the weight of ram assembly 238 to be reduced significantly, while also assisting in providing a ram assembly that meets the objectives of the instant invention. Yet another feature shown in FIGS. 9 through 11 is lubrication passage 349 extending through anti-rotation pin 348 to provide lubrication to rotational thrust bearing 380. Also shown in the second embodiment is thrust plate 384 which may be utilized in connection with either embodiment. This is a replaceable, bronze ring that fits between screw nut 344 and ram piston portion 350. Grease clean-out 410 is also shown connected to housing 230.

Another optional feature shown in FIGS. 9 through 11 is the inclusion of passage 400 extending axially through actuator screw 274. This passage can be utilized to provide an easy and protected link between various components of the coupler assembly. In the instant invention, passage 400 is utilized to provide lubrication to ram head 244. A tube extends through passage 400 and hollow piston region 351 to carry the lubrication to the ram head. The tube is expandable to easily tolerate extension and retraction of the ram assembly. The tube includes inner portion 402 and outer portion 404. Inner portion 402 has an outer diameter equal to or slightly less than the inner diameter of outer portion 404 so that inner portion 402 may fit and slide within outer portion 404. Inner portion 402 extends within outer portion 404 an amount sufficient to accommodate the axial travel of the ram assembly by maintaining inner portion 402 within outer portion 404 at all times. The tube can further includes seals, or other suitable features known in the art to contain the lubrication fluid within the telescoping tube.

As with the prior art coupler assembly described above, it may be desirable to rotate helmet 244 to properly align helmet 244 with channel 18 during coupling. Unlike the ram of the prior art assembly, which can be rotated by rotation of the actuator screw, rotation of ram piston portion 350 of the instant invention cannot be controlled by actuator screw 274. Thus it may be necessary to provide a mechanism for manually rotating ram piston portion 350 relative to screw nut 344 and thereby align helmet 244. One possible mechanism might be a rack and pinion gear system. In such a system the inner diameter of extraction ring 352 can include teeth that mate with the teeth of a pinion gear. The pinion gear can be rotatably attached to screw nut 344 and/or anti-rotation pin 348 via bearings. The rack is then attached to either screw nut 344 or anti-rotation pin 348. A clutch is included to engage the pinion gear with the rack. When the clutch is engaged, the pinion gear will be engaged with the rack, allowing linear movement of the rack to rotate the pinion gear and thereby rotate extraction ring 352 and ram piston portion 350. When the clutch is disengaged, the pinion gear will be disengaged from the rack, and the pinion gear, extraction ring 352, and ram piston portion 350 will rotate freely.

The instant invention utilizes a single two-speed brake motor and gearbox that directly drives the ram extending screw. The motor and drive provides high range travel speed at low force and low range travel speed at half the high range speed and double the high range ram force. High range is used to quickly engage the tug rams into the barge channels (or ladders); the low range is used to increase the engagement force on the rams. At maximum low range torque, the motor is stopped and the motor brake is applied; there will be no additional rotation of the ram extending drive while the tug is coupled to the barge. After the motor brake is set, the ram load cell will be pressurized to provide an extension force.

An electrically driven tandem pump for load cell pressurization and lubrication will charge an accumulator that is used to provide the extension force pressure. A check valve is provided to isolate the load cell from the charging system and reduce load cell pressure in the event of transverse ram forces that are larger than the initial engagement force.

In the foregoing description, certain terms have been used for brevity, clearness and understanding, but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive apparatus for coupling tugboats to barges is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention, what is claimed as new and desired to be secured by Letters Patent is as follows:

1. A coupler assembly for installation on a pusher vessel to couple the vessel with a barge when extended into a cavity in a stern notch in the barge, said coupler assembly comprising:

a housing adapted to be mounted on the pusher vessel;

an extendable and retractable ram mounted in said housing;

an actuator screw supported in said housing for rotation and including a threaded connection with said ram to effect axial extension and retraction of said ram by threading action when said screw is turned in opposite directions; and a load cell for effecting axial movement of said ram relative to said housing.

2. The coupler assembly as claimed in claim 1 wherein said load cell is positioned between said screw and said housing to effect axial movement of said screw relative to said housing and therethrough effect said axial movement of said ram relative to said housing.

3. The coupler assembly as claimed in claim 1 wherein said load cell is positioned between said screw and said ram to effect axial movement of said ram relative to said screw and thereby effect said axial movement of said ram relative to said housing.

4. The coupler assembly as claimed in claim 3 wherein said ram further comprises:

a first portion threadedly engaged with said screw;

and a second portion associated with said first portion for axial movement of said second portion relative to said first portion by said load cell.

5. A coupler assembly for installation on a pusher vessel to couple the vessel with a barge when extended into a cavity in a stern notch in the barge, said coupler assembly comprising:

a housing adapted to be mounted on the pusher vessel;

an extendable and retractable ram mounted in said housing;

an actuator screw supported in said housing for rotation and including a threaded connection with said ram to effect axial extension and retraction of said ram by threading action when said screw is turned in opposite directions;

a bushing slidably connecting said screw to said housing; and a load cell positioned to effect axial movement of said screw relative to said housing and to therethrough effect axial movement of said ram relative to said housing.

6. The coupler assembly as claimed in claim 5 wherein said load cell is positioned between said housing and said screw.

7. The coupler assembly as claimed in claim 5 further comprising a shoulder on said screw associated with said load cell.

8. The coupler assembly as claimed in claim 7 further comprising a thrust ring positioned between said load cell and said shoulder.

9. The coupler assembly as claimed in claim 5 further comprising a collar on said screw for contacting a stop upon axial movement of said screw.

10. The coupler assembly as claimed in claim 9 wherein said stop comprises a thrust bearing connected to said housing.

11. The coupler assembly as claimed in claim 5 wherein said load cell comprises:

a piston portion associated with said screw; and a chamber portion associated with said housing.

12. The coupler assembly as claimed in claim 5 wherein said ram comprises:

a non-rotatable first portion threadedly engaged with said screw;

a second portion associated with said first portion, said second portion capable of rotational movement relative to said first portion and said housing; and an extraction member connected to said second portion.

13. The coupler assembly as claimed in claim 12 further comprising a rotational thrust bearing positioned between said first portion and said second portion.

14. The coupler assembly as claimed in claim 12 wherein said housing comprises an axial groove and said first portion comprises an anti-rotation pin slidably engaged with said axial groove.

15. The coupler assembly as claimed in claim 14 further comprising a grease clean-out associated with said axial groove.

16. The coupler assembly as claimed in claim 12 wherein said extraction member comprises an annular ring, a segment of which engages with an inner end of said first portion upon axial retraction of said first portion.

17. The coupler assembly as claimed in claim 12 wherein said second portion comprises a bushing slidably connecting said second portion to said screw.

18. The coupler assembly as claimed in claim 5 further comprising a helmet on an outer end of said ram.

19. The coupler assembly as claimed in claim 18 wherein said helmet is non-rotatable relative to said ram.

20. The coupler assembly as claimed in claim 5 wherein said housing comprises a bushing slidably connecting said housing to said ram.

21. The coupler assembly as claimed in claim 5 further comprising a motor connected to said actuator screw, said motor capable of rotating said actuator screw.

22. The coupler assembly as claimed in claim 5 further comprising a brake associated with said actuator screw for restricting rotation of said screw.

23. A coupler assembly for installation on a pusher vessel to couple the vessel with a barge when extended into a cavity in a stern notch in the barge, said coupler assembly comprising:

a housing adapted to be mounted on the pusher vessel;

an extendable and retractable ram mounted in said housing, said ram including a non-rotatable first portion capable of axial movement relative to said housing, a second portion associated with said first portion, said second portion capable of rotational movement relative to said first portion and said housing, and an extraction member connected to said second portion; and an actuator screw supported in said housing for rotation and including a threaded connection with said first portion of said ram to effect axial extension and retraction of the first portion by threading action when said screw is turned in opposite directions;

wherein upon axial extension of said first portion, said first portion engages contact with said second portion to effect axial extension of said second portion of said ram; and wherein upon axial retraction of said first portion, said first portion engages contact with said extraction member to effect axial retraction of said second portion of said ram.

24. The coupler assembly as claimed in claim 23 further comprising a load cell for providing axial movement of said ram relative to said housing.

25. The coupler assembly as claimed in claim 24 wherein said load cell is positioned to provide axial movement of said screw relative to said housing and therethrough provide axial movement of said ram relative to said housing.

26. The coupler assembly as claimed in claim 24 wherein said load cell is positioned to provide axial movement of said ram relative to said screw and thereby provide said axial movement of said ram relative to said housing.

27. The coupler assembly as claimed in claim 26 wherein said load cell is positioned to provide axial movement of said second portion of said ram relative to said first portion of said ram and thereby provide said axial movement of said ram relative to said housing.

28. The coupler assembly as claimed in claim 27 wherein said load cell comprises:

a piston portion connected to said first portion of said ram; and a chamber portion connected to said second portion of said ram.

29. The coupler assembly as claimed in claim 23 further comprising a rotational thrust bearing positioned between said first portion and said second portion.

30. The coupler assembly as claimed in claim 29 further comprising a spring positioned between said thrust bearing and at least one of said first and second portions of said ram.

31. The coupler assembly as claimed in claim 23 wherein said housing comprises an axial groove and said first portion comprises an anti-rotation pin slidably engaged with said axial groove.

32. The coupler assembly as claimed in claim 31 further comprising a grease clean-out associated with said axial groove.

33. The coupler assembly as claimed in claim 23 wherein said extraction member comprises an annular ring, a segment of which engages contact with an inner end of said first portion upon axial retraction of said first portion.

34. The coupler assembly as claimed in claim 23 further comprising a helmet on an outer end of said second portion.

35. The coupler assembly as claimed in claim 34 wherein said helmet is non-rotatable relative to said second portion.

36. The coupler assembly as claimed in claim 23 wherein said second portion comprises a bushing slidably connecting said second portion to said screw.

37. The coupler assembly as claimed in claim 23 wherein said housing comprises a bushing slidably connecting said housing to said ram.

38. The coupler assembly as claimed in claim 23 further comprising a motor connected to said actuator screw, said motor capable of rotating said actuator screw.

39. The coupler assembly as claimed in claim 23 further comprising a brake associated with said actuator screw for restricting rotation of said screw.

40. A coupler assembly for installation on a pusher vessel to couple the vessel with a barge when extended into a cavity in a stern notch in the barge, said coupler assembly comprising:

a housing adapted to be mounted on the pusher vessel;

an extendable and retractable ram mounted in said housing, said ram including a first portion capable of axial movement relative to said housing, a second portion associated with said first portion, said second portion capable of axial movement relative to said first portion and said housing, an extraction member connected to said second portion, and a load cell associated with said first and second portions to effect said axial movement of said second portion relative to said first portion; and an actuator screw supported in said housing for rotation and including a threaded connection with said first portion of said ram to effect axial extension and retraction of the first portion by threading action when said screw is turned in opposite directions;

wherein upon axial extension of said first portion, said first portion engages contact with said second portion to effect axial extension of said second portion of said ram; and wherein upon axial retraction of said first portion, said first portion engages contact with said extraction member to effect axial retraction of said second portion of said ram.

41. A method of coupling a pusher vessel to a barge, the barge including a stern notch having a cavity therein, the pusher vessel having an actuator screw-driven ram that extends from the pusher vessel into the cavity in the stern notch, said method comprising the step of activating a load cell to provide a tight connection between the ram and the barge.

42. The method as claimed in claim 41 further comprising the step of operating the actuator screw to extend the ram from the pusher vessel into the cavity in the stern notch and ceasing said operation of the actuator screw upon engagement of the ram with the barge.

43. The method as claimed in claim 41 further comprising the step of positioning said load cell to provide axial movement of the actuator screw relative to the pusher vessel and therethrough provide axial movement of the ram relative to the pusher vessel.

44. The method as claimed in claim 41 further comprising the step of positioning said load cell to provide axial movement of the ram relative to the screw.

45. The method as claimed in claim 44 further comprising the steps of:

providing a two piece ram including a non-rotatable first portion capable of axial movement relative to the pusher vessel, and a second portion capable of axial movement relative to the first portion and the pusher vessel; and positioning said load cell between said first portion and said second portion to provide axial movement of said second portion relative to said first portion.

46. The method as claimed in claim 41 further comprising the steps of:

deactivating the load cell; and operating the actuator screw to retract the ram from the barge to decouple the barge and pusher vessel.

47. A method of coupling a pusher vessel to a barge, the barge including a stern notch having a cavity therein, the method comprising the steps of:

operating an actuator screw to extend a ram from the pusher vessel into the cavity in the stern notch; and activating a load cell to provide a tight connection between the ram and the barge.

48. The method as claimed in claim 47 further comprising the step of ceasing said operation of said actuator screw upon engagement of the ram with the barge.

* * * * *